US006624370B1

(12) United States Patent
Soga et al.

(10) Patent No.: US 6,624,370 B1
(45) **Date of Patent: *Sep. 23, 2003**

(54) GAS CIRCUIT BREAKER

(75) Inventors: Takuichiro Soga, Hitachi (JP); Junzo Kida, Hitachi (JP); Wataru Tamura, Kashiwa (JP); Hideo Kawamoto, Hitachi (JP); Takeshi Iryo, Kashiwa (JP)

(73) Assignee: Hitachi, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/634,995

(22) Filed: Aug. 8, 2000

(30) Foreign Application Priority Data

Aug. 9, 1999 (JP) ..... 11-224912

(51) Int. Cl.[7] ..... H01H 33/70
(52) U.S. Cl. ..... 218/43; 218/154
(58) Field of Search ..... 218/43–44, 45, 218/48, 49, 50, 58, 61, 68–9, 78, 84, 154–5

(56) References Cited

U.S. PATENT DOCUMENTS 3,857,006 A * 12/1974 Daimon et al. ..... 218/154
3,941,963 A * 3/1976 Sasaki et al. ..... 218/43
5,483,031 A * 1/1996 Matsuda ..... 218/48
5,736,704 A * 4/1998 Asselin et al. ..... 218/68

FOREIGN PATENT DOCUMENTS

JP 4-87126 3/1992
JP 8-115642 5/1996

* cited by examiner

*Primary Examiner*—Lincoln Donovan
(74) *Attorney, Agent, or Firm*—Mattingly, Stanger & Malur, P.C.

(57) ABSTRACT

A highly reliable gas circuit breaker capable of improving the braking performance and the insulating performance and a gas circuit breaker capable of allowing a stress acting on the supporting member of the electrode are provided.

The gas circuit breaker comprising a grounded tank filled with an insulation medium; a movable electrode arranged inside the grounded tank; a fixed electrode which is supported through an insulator supporting member inside the grounded tank and disposed detachably from and oppositely to the movable electrode; and electric conductive parts individually provided in the movable electrode and the fixed electrode, wherein the insulator supporting member is a solid cone and supports the fixed electrode in an upper side of a central axis of the grounded tank.

19 Claims, 7 Drawing Sheets

| | | |
|---|---|---|
| SECTIONAL FORM | ELLIPSE  | CIRCLE  |
| EXHAUSTING PERFORMANCE | HIGH ⟷ LOW | |
| STRUCTURAL STRENGTH | LOW ⟷ HIGH | |

(ASSUMING THAT THE SECTIONAL AREA IS EQUAL TO EACH OTHER)

GAS CIRCUIT BREAKER

BACKGROUND OF THE INVENTION

The present invention relates to a gas circuit breaker and, more particularly to a gas circuit breaker comprising a supporting structure of a fixed electrode suitable for improving the breaking performance and the insulating performance.

As disclosed, for example, in Japanese Patent Application Laid-Open No.4-87126, in a conventional gas circuit breaker, a fixed electrode is supported in a grounded tank through a cylindrical insulator supporting member arranged on a central axis of the grounded tank. Further, a shielding member surrounds around a fixed arcing contact so that an insulation gas heated up to high temperature by an arc generated between contacts is not directly in contact with the insulator supporting member.

Further, as disclosed in Japanese Patent Application Laid-Open No.8-115642, there is known a gas circuit breaker in which a fixed electrode is supported by arranging an insulator supporting member in the outer peripheral side of a fixed electrode and in a lower portion of a grounded tank.

However, when the shielding member surrounds around the fixed arcing contact as in the former gas circuit breaker, the exhausting performance of the insulation gas heated up to high temperature is deteriorated because the exhausting performance of the high temperature insulation gas stagnates inside the shield and consequently the breaking performance may be deteriorated by the high temperature insulation gas particularly, in a small-sized large-capacity gas breaker.

In order to solve this problem, it is considered that the exhausting performance of the high temperature insulation gas is improved by removing the shielding member, but the high temperature insulation gas comes in direct contact with the insulator supporting member supporting the fixed electrode and consequently the insulation is deteriorated due to stain along the surface of the insulator supporting member to decrease the insulation performance.

On the other hand, it is considered that the insulator supporting member is arranged in the outer peripheral side of the fixed electrode and in a lower portion of a grounded tank, as in the latter gas circuit breaker. However, in this method, when electric conductive extraneous objects are mixed into the grounded tank, the mixed electric conductive extraneous objects are easily attached the insulator supporting member to decrease the insulating performance due to the electric conductive extraneous objects.

Furthermore, in a gas circuit breaker in which the bushing portion is attached to the grounding tank in inclining with respect to the vertical direction, a torsion stress as well as a bending stress is also produced in the breaking portion. Therefore, in a case where the fixed electrode is supported by the grounding tank, it is necessary to design the supporting structure capable of allowing the bending stress and the torsion stress. In addition, a load produced at an earthquake or at transporting the gas circuit breaker or an electromagnetic force caused at current conducting acts on the supporting member of the electrode, it is necessary to design the supporting structure capable of allowing these forces.

SUMMARY OF THE INVENTION

The present invention is to solve the above-mentioned problems. The first typical object of the present invention is to provide a highly reliable gas circuit breaker which is capable of improving the braking performance and the insulating performance. The second typical object of the present invention is to provide a gas circuit breaker which is tolerable of a stress acting on the supporting member of the electrode. The third typical object of the present invention is to provide a highly reliable gas circuit breaker which is capable of allowing a stress acting on the supporting member of the electrode and at the same time capable of improving the braking performance and the insulating performance.

The present invention is essentially characterized by that an insulator supporting member supports a fixed electrode in an upper side of a central axis of a tank, that is, that the insulator supporting member for supporting the fixed electrode is arranged in an upper-half space of the cylindrical tank to support the fixed electrode. In the present invention, by the construction, a space for exhausting insulation gas heated up to high temperature is formed in the lower side of the central axis of the tank and in the fixed electrode side opposite to the movable electrode so that the insulation gas heated up to high temperature is exhausted to the space. Therefore, it is possible to prevent the insulation gas heated up to high temperature from directly contact with the insulator supporting member and at the same time to improve the performance of exhausting the insulation gas heated up to high temperature.

Further, the present invention is essentially characterized by that the insulator supporting member of the fixed electrode is a solid cone, and the insulator supporting member is a circular frustum having a circular sectional shape or an elliptical frustum having an elliptical sectional shape. In the present invention, by the construction, it is possible to be tolerable of a stress acting on the insulator supporting member. Therefore, according to an embodiment of the present invention, it is provided a gas circuit breaker comprising a tank filled with an insulation medium; a movable electrode arranged inside the tank; a fixed electrode which is supported through an insulator supporting member inside the tank and disposed detachably from and oppositely to the movable electrode; and electric conductive parts individually provided in the movable electrode and the fixed electrode, wherein the insulator supporting member supports the fixed electrode in an upper side of a central axis of the tank.

According to another embodiment of the present invention, it is provided a gas circuit breaker comprising a tank filled with an insulation medium; a movable electrode arranged inside the tank; a fixed electrode which is supported through an insulator supporting member inside the tank and disposed detachably from and oppositely to the movable electrode; and electric conductive parts individually provided in the movable electrode and the fixed electrode, wherein the insulator supporting member is a solid cone.

According to a further embodiment of the present invention, it is provided a gas circuit breaker comprising a tank filled with an insulation medium; a movable electrode arranged inside the tank; a fixed electrode which is supported through an insulator supporting member inside the tank and disposed detachably from and oppositely to the movable electrode; and electric conductive parts individually provided in the movable electrode and the fixed electrode, wherein the insulator supporting member is a solid cone and supports the fixed electrode in an upper side of a central axis of the tank.

DESCRIPTION OF THE PREFERRED EMBODIMENTS

Figure 1:
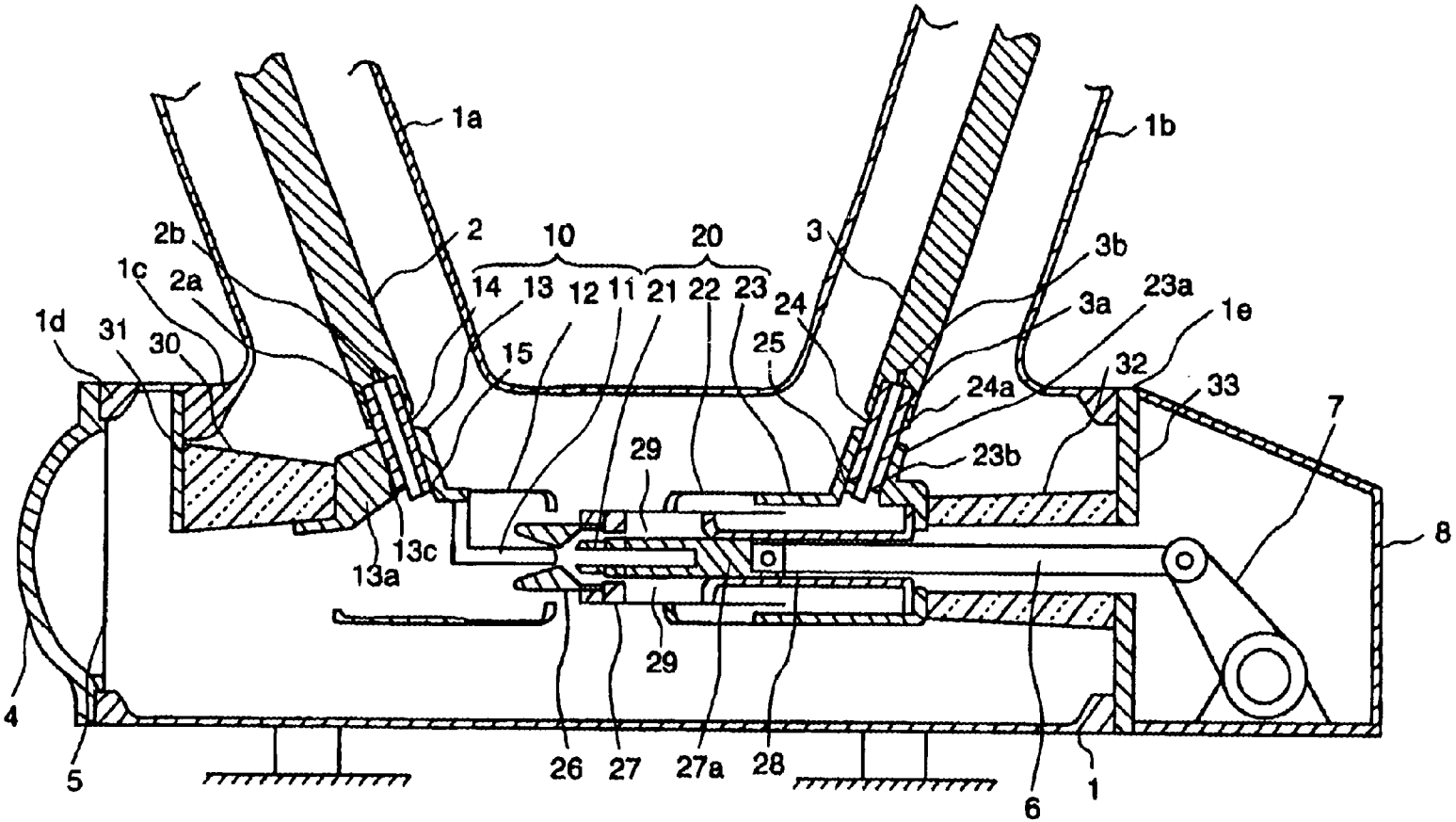
FIG. 1 is a cross-sectional view showing the structure of an embodiment of a gas circuit breaker in accordance with the present invention.
Figure 2:
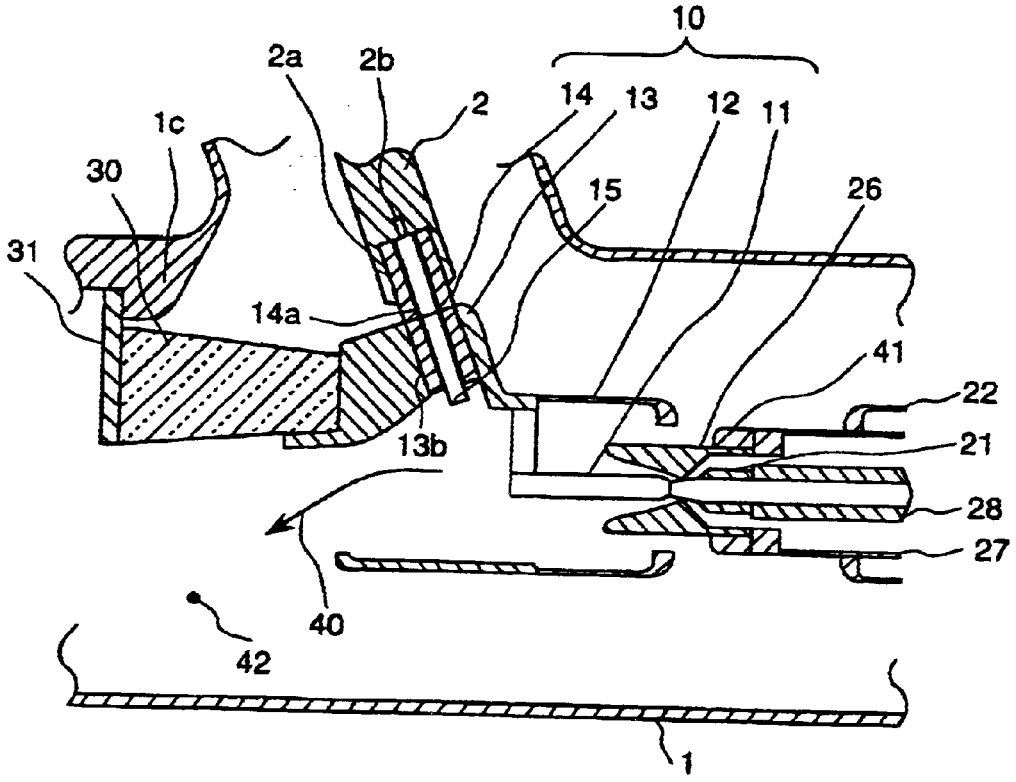
FIG. 2 is an enlarged cross-sectional view showing the structure of the fixed electrode side of FIG. 1.

FIG. 1 and FIG. 2 show the structure of an embodiment of a gas circuit breaker in accordance with the present invention. The reference character 1 in the figure is a cylindrical grounded tank (a grounded container) filled with a gas insulation medium such as $SF_6$ (sulfur hexafluoride) gas. In the upper portion of the grounding tank 1 there are provided cylindrical branch pipes 1*a*, 1*b* each for branching in inclining with respect to the vertical direction towards end portions of the grounding tank 1. At the top end of each of the branch pipes 1*a*, 1*b* there is provided a bushing, not shown. At the top end of each of the bushings there are provided a terminal, not shown.

On the central axis of the branch pipe la and the bushing provided at the top ends of the branch pipe 1*a*, there is disposed a rod-shaped electric conductive part 2 electrically connected to the terminal at the top end of the bushing. In the central portion of the electric conductive part 2 in the side opposite to the terminal there is provided a depressed portion 2*a*, and in the bottom central portion of the depressed portion 2*a* there is provided a screw hole 2*b*. On the central axis of the branch pipe 1*b* and the bushing provided at the top ends of the branch pipe 1*b*, there is disposed a rod-shaped electric conductive part 3 electrically connected to the terminal at the top end of the bushing. In the central portion of the electric conductive part 3 in the side opposite to the terminal there is provided a depressed portion 3*a*, and in the bottom central portion of the depressed portion 3*a* there is provided a screw hole 3*b*.

A pair of electrodes composing a breaking part are contained in the grounded tank 1. The pair of electrodes are composed of a fixed electrode 10 and a movable electrode 20 which are constructed detachably in the central axis direction of the grounded tank 1 and arranged on the central axis of the grounded tank 1.

The fixed electrode 10 is composed of a fixed arcing contact 11 of an L-shaped electric conductive rod conductor; a fixed main contact 12 arranged so as to surround the fixed arcing contact 11; and a fixed gas-exhausting conductor part 13 of electric conductive cylindrical conductor. The fixed arcing contact 11 is fixed onto the inner surface of an end portion of the fixed gas-exhausting conductor part 13 in the movable electrode 20 side so as to be positioned on the central axis of the grounded tank 1. The fixed main contact 12 is fixed to the top end of the fixed gas-exhausting conductor part 13 in the movable electrode 20 side.

The fixed gas-exhausting conductor part 13 is a cast body made of copper or aluminum. In the fixed gas-exhausting conductor part 13, a connecting part 13*a* with the fixed insulator supporting member 30 to be described later is formed in the upper side of the central axis of the grounded tank 1. The connecting part 13*a* has a wall thickness thicker than those of the other parts of the fixed gas-exhausting conductor part 13, and is gradually inclined toward the inner peripheral side from the side of the movable electrode 20 to the side opposite to the movable electrode 20, and the lower end portion of the connecting part 13*a* in the opposite side of the movable electrode 20 is further projected toward the side opposite to the movable electrode 20 than the surface in contact with the side surface of the fixed insulator supporting member 30. A though hole 13*b* having an equal diameter to that of a depressed portion 2*a* of the electric conductive part 2 is formed in a portion facing the depressed portion 2*a* of the connecting part 13*a* of the fixed gas-exhausting conductor part 13.

The fixed gas-exhausting conductor part 13 and the electric conductor part 2 are electrically connected to each other through an electric conductive connecting conductor part 14. The connecting conductor part 14 is inserted into the through hole 13*b* from the inner peripheral side of the fixed gas-exhausting conductor part 13 to be engaged with the depressed portion 2*a* of the electric conductive part 2. A through hole 14*a* is formed in the connecting conductor part 14 in the direction of the central axis. A conductor retainer 15 is screwed into the hole 14*a* of the connecting conductor part 14 to be fastened together to a screw hole 2*b* of the electric conductive part 2.

Figure 3:
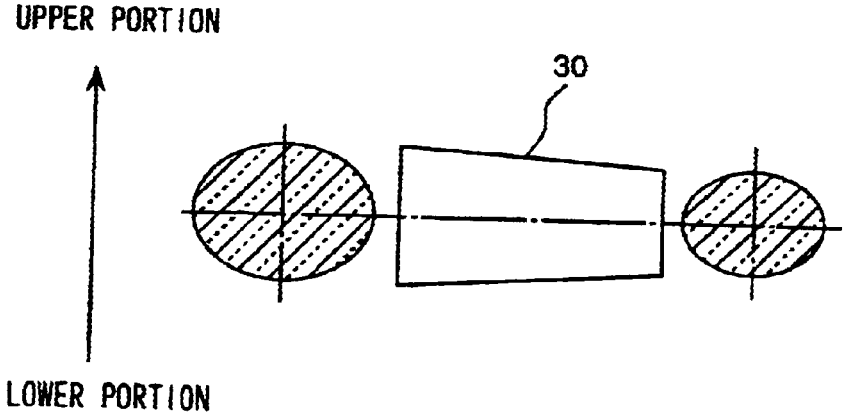
FIG. 3 is a plan view showing the shape of the fixed insulator supporting member of FIG. 2.
Figure 4:
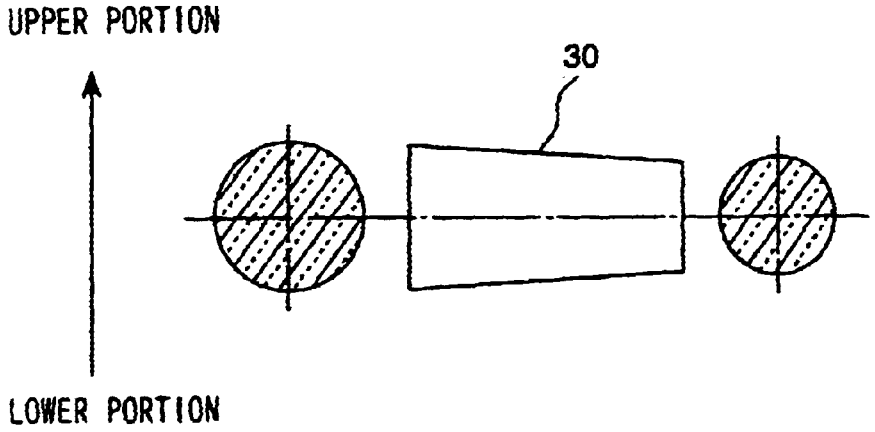
FIG. 4 is a plan view showing the shape of the fixed insulator supporting member of FIG. 2.

The fixed insulator supporting member 30 is fixed to the connecting part 13*a* of the fixed gas-exhausting conductor part 13 using a bolt or the like. The fixed insulator supporting member 30 is a solid member made of epoxy resin, and is an elliptical frustum member having an elliptical sectional shape flat with respect to the horizontal direction as shown in FIG. 3 or a circular frustum member having a circular sectional shape as shown in FIG. 4. Therein, the circular frustum or the elliptical frustum is a kind of cone. That is, a circular cone or an elliptical cone is cut in a plane parallel to the bottom of the cone, and then the circular frustum or the elliptical frustum is obtained as a three-dimensional body between the cut plane and the bottom of the cone. In other words, the circular frustum or the elliptical frustum is a three-dimensional body in which the planes parallel to the bottom are gradually increased from the top side to the bottom side in keeping the similar figures. In addition, the top side surface of the circular frustum or the elliptical frustum indicates the smallest surface of the surfaces having the sectional shape, and the bottom side surface of the circular frustum or the elliptical frustum indicates the largest surface of the surfaces having the sectional shape.

A fixed supporting plate 31 is fixed onto the surface of the fixed insulator supporting member 30 in the side opposite to the fixed gas-exhausting conductor part 13 using a bolt or the like. The fixed supporting plate 31 is a supporting member made of a metal such as iron, and fixes the fixed insulator supporting member 30 in the bottom side. Therefore, the top side of the fixed insulator supporting member 30 is fixed to the connecting part 13*a* of the fixed gas-exhausting conductor part 13. The fixed supporting plate 31 is fixed to a fixing base 1*c* provided in the inner surface of the grounded tank 1 using a bolt or the like.

On the other hand, the movable electrode 20 is composed of a movable arcing contact 21; a movable main contact 22; a movable gas-exhausting conductor part 23; an insulator nozzle 26; a puffer cylinder 27; and a puffer piston 28. The movable arcing contact 21 detachably facing the fixed arcing contact 11, and is fixed to the central portion of the end surface of the puffer cylinder 27 in the fixed electrode 10 side.

The insulator nozzle 26 is fixed to the top end of the puffer cylinder 27 in the fixed electrode 10 side so as to surround the fixed arcing contact 11. The insulator nozzle 26 forms a flow path for conducting an arc-extinguishing gas blown out from a puffer chamber 29 formed by the puffer cylinder 27 and the puffer piston 28 to the top end side of the movable arcing contact 21. An axis 27*a* of the puffer cylinder 27 is movably supported by a hollow portion of the puffer piston 28. One end of the insulator rod 6 is connected to the axis 27*a* of the puffer cylinder 27.

The puffer piston 28 fixes the movable gas-exhausting conductor part 23 using a bolt or the like. The movable gas-exhausting conductor part 23 is a cylindrical electric conductive supporting member which is a cast body made of copper or aluminum. The movable main contact 22 is fixed to the top end of the movable gas-exhausting conductor part 23 in the fixed electrode 10 side so as to surround the buffer cylinder 27. A projecting portion 23*a* is provided at a portion of the movable gas-exhausting conductor part 23 opposite to the electric conductive part 3. A though hole 23*b* having an equal diameter to that of a depressed portion 3*a* is formed in a portion facing the depressed portion 3*a* of the electric conductive part 3 of the projecting part 23*a*.

The movable gas-exhausting conductor part 23 and the electric conductor part 3 are electrically connected to each other through an electric conductive connecting conductor part 24. The connecting conductor part 24 is inserted into the through hole 23*b* from the inner peripheral side of the movable gas-exhausting conductor part 23 to be engaged with the depressed portion 3a of the electric conductive part 3. A through hole 24*a* is formed in the connecting conductor part 24 in the direction of the central axis. A conductor retainer 25 is screwed into the hole 24*a* of the connecting conductor part 24 to be engaged with a screw hole 3*b* of the electric conductive part 3.

The movable insulator supporting member 32 is fixed to the movable gas-exhausting conductor part 23 using a bolt or the like. The movable insulator supporting member 32 is a cylindrical member made of epoxy resin. A movable supporting plate 33 is fixed to a portion of the movable insulator supporting member 32 in the opposite side of the movable gas-exhausting conductor part 23 using a bolt or the like. The movable supporting plate 33 is a supporting member made of a metal such as iron. The movable supporting plate 33 is fixed to a flange 1*e* provided on the inner surface of the grounding tank 1 using a bolt or the like.

The other end of the insulator rod 6 is projected from the end portion of the movable electrode 20 of the grounded tank 1, and connected to a link mechanism 7 which is connected to an operating mechanism, not shown in the figure. A mechanism case 8 is fixed to the end portion of the grounded tank 1 in the side of the movable electrode 20 using bolts or the like so as to cover the link mechanism 7. The mechanism case 8 is filled with a gas insulation medium such as $SF_6$ (sulfur hexafluoride) gas.

A hemispheric lid part 4 convex outward on an axial direction of the grounded tank 1 is fixed to the flange 1d in the end portion of the grounded tank 1 in the side of the fixed electrode 10 using bolts or the like. A partition plate 5 is provided in the lid part 4 so as to separate a space of the lid part 4 from a space of the grounded tank 1. Through holes are provided in the partition plate 5 so that the insulation gas can be communicate between the space of the lid part 4 and the space of the grounded tank 1. A moisture absorbent for removing moisture is contained in the space of the lid part 4 partitioned by the partition plate 5.

Operation of the gas circuit breaker of the present embodiment at circuit breaking will be described below. As the actuator is operated by a circuit breaking operation command, the insulator rod 6 is moved in the right-hand direction in the figure (the direction toward the end portion side of the movable electrode 20 of the grounded tank 1). Accordingly, the buffer cylinder 27, the movable arcing contact 21 and the insulator nozzle 26 are moved in the same direction as the movement of the insulator rod 6, the fixed main contact 12 is detached from the movable arcing contact 21 and the fixed arcing contact 11 is detached from the movable arcing contact 21. At that time, an arc 41 is produced between the movable arcing contact 21 and the fixed arcing contact 11.

On the other hand, as the puffer cylinder 27 is moved accompanied the movement of the insulator rod 6, the insulation medium ($SF_6$ gas) inside the puffer chamber 29 is compressed by the puffer cylinder 27. After the fixed arcing contact 11 detaching from the movable arcing contact 21, the compressed insulation medium is blown between them to extinguish the arc 41. The blown arc-extinguishing gas is heated up to high temperature by the arc 41, and becomes a high temperature gas 40 containing metallic vapor which is melted out from the arc producing portions of the movable arcing contact 21 and the fixed arcing contact 11.

The high temperature gas 40 flows out mainly through the inside of the fixed main gas-exhausting conductive part 13 and is exhausted to the exhausting space 42 of the space in the end portion of the grounded tank 1 in the fixed electrode 10 side. At that time, the high temperature gas 40 is smoothly exhausted into the exhausting space 42 without interrupting flow and without directly contact with the fixed insulator supporting member 30 because the fixed insulator supporting member 30 supports the fixed gas-exhausting conductive part 13 in the upper side of the central axis of the grounded tank 1, that is, in the upper-half space of the grounded tank 1. The high temperature gas 40 exhausted in the exhausting space 42 is mixed with the low temperature insulation medium in the exhausting space 42 and is cooled by natural cooling.

According to the present embodiment described above, since the fixed gas-exhausting conductive part 13 is supported by the fixed insulator supporting member 30 in the upper side of the central axis of the grounded tank 1, that is, in the upper-half space of the grounded tank 1, the exhausting space 42 is formed in the side opposite to the movable electrode 20 of the fixed gas-exhausting conductive part 13. Therefore, the high temperature gas 40 is smoothly exhausted into the exhausting space 42 without stagnating in the portion near the circuit breaking portion and without directly contact with the fixed insulator supporting member 30. Accordingly, it is possible to improve the performance of exhausting the high temperature gas 40 and at the same time it is possible to prevent the surface of the fixed insulator supporting member 30 from being stained.

Further, according to the present embodiment, since the connecting part 13*a* of the fixed gas-exhausting conductive part 13 is gradually inclined toward the inner peripheral side from the side of the movable electrode 20 to the side opposite to the movable electrode 20, it is possible to further improve the effect of preventing the high temperature gas 40 from directly in contact with the fixed insulator supporting member 30. Furthermore, since the lower end portion of the connecting part 13*a* of the fixed gas-exhausting conductive part 13 in the side opposite to the movable electrode 20 is further projected toward the opposite side of the movable electrode 20 than the contact surface with the side surface of the fixed insulator supporting member 30, it is possible to cover the lower portion of the fixed insulator supporting member 30 in the fixed electrode 10 side, and accordingly to further improve the effect of preventing the high temperature gas 40 from directly in contact with the fixed insulator supporting member 30.

Still further, according to the present embodiment, since the fixed insulator supporting member 30 supports the fixed gas-exhausting conductive part 13 in the upper side of the central axis of the grounded tank 1, that is, in the upper-half space of the grounded tank 1, it is possible to prevent electric conductive extraneous objects from attaching onto the fixed insulator supporting member 30 even if the extraneous objects are mixed into the grounded tank 1, and accordingly the insulation performance can be improved.

Figure 5:
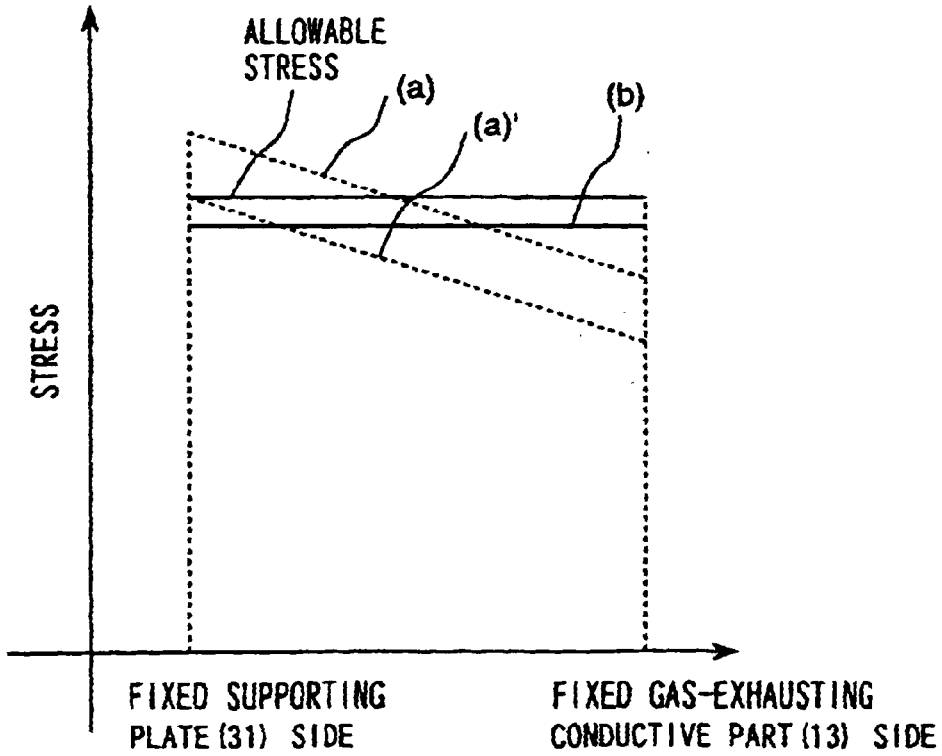
FIG. 5 is a graph showing the stress distribution in the longitudinal direction of the fixed insulator supporting member of FIG. 3 or FIG. 4.

Further, according to the present embodiment, since the solid elliptical frustum member shown in FIG. 3 or the solid circular frustum member shown in FIG. 4 is used as the fixed insulator supporting member 30, the produced stress acting on the fixed insulator supporting member 30, that is, load acting on the fixed insulator supporting member 30 at an earthquake or at transportation or an electromagnetic force at conducting current can be evenly distributed along the longitudinal direction of the fixed insulator supporting member 30. This phenomenon will be described below, referring to FIG. 5. FIG. 5 is a graph showing the stress distribution in the longitudinal direction of the fixed insulator supporting member 30, and therein, the line (a) in the graph shows the stress distribution for a supporting member in which the sectional area is constant along the longitudinal direction, and the line (b) shows the stress distribution for a supporting member in accordance with the present embodiment in which the sectional area is linearly varied along the longitudinal direction.

It is clear from FIG. 5 that in the case of (a) where the sectional area is constant along the longitudinal direction, the stress acting on a position near the fixed supporting plate 31 exceeds the allowable stress. Further, when the stress acting on a position near the fixed supporting plate 31 is tried to be reduced lower than the allowable stress, as shown by the line (a)', the stress acting on a position near the fixed gas-exhausting conductive part 13 becomes excessively lower than the allowable stress and accordingly the sectional area of the supporting member becomes excessively large. On the other hand, by employing the frustum fixed insulator supporting member as the present embodiment, the distribution of stress acting on the supporting member can be made even along the longitudinal direction. Therein, a quadrangular frustum member or a triangular frustum member can be used as the fixed insulator supporting member 30, but in this case, stress concentration may occur because they have corner portions.

Figure 6:
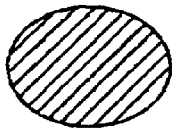
FIG. 6 is a comparative matrix showing the characteristics depending on the sectional shapes in the longitudinal direction of the fixed insulator supporting member of FIG. 3 and FIG. 4.
Figure 6:
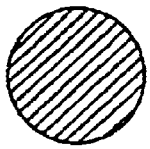

Further, in accordance with the present embodiment, since the sectional shape of the fixed insulator supporting member 30 in the longitudinal direction is elliptical as shown in FIG. 3 or circular a shown in FIG. 4, the bending stress or the torsion stress acting on the circuit breaking portion by the bushing is tolerable. As shown in FIG. 6, the structural strength of the fixed insulator supporting member 30 is higher in the case of the circular sectional shape in the longitudinal direction than in the case of the elliptical sectional shape. On the other hand, in the case of the elliptical sectional shape in the longitudinal direction, the gas-exhausting space 42 can be made large and accordingly the exhausting performance can be further improved. In addition, in the case of the elliptical sectional shape in the longitudinal direction, the gas-exhausting opening of the fixed gas-exhausting conductive part 13 can be made large and accordingly replacing of the fixed arcing contact 11, the movable arcing contact 21 and the insulator nozzle 26 can be performed from the gas-exhausting opening of the fixed gas-exhausting conductive part 13.

Furthermore, according to the present embodiment, since the fixed gas-exhausting conductive part 13 and the electric conductor part 2 are electrically connected by the connected conductor part 14, work such as maintenance work, inspection work and replacing work of the circuit breaking portion can be performed without taking off the electric conductor part 2. The work for taking off the circuit breaking portion will be described below, referring to FIG. 7 to FIG. 10.

Figure 7:
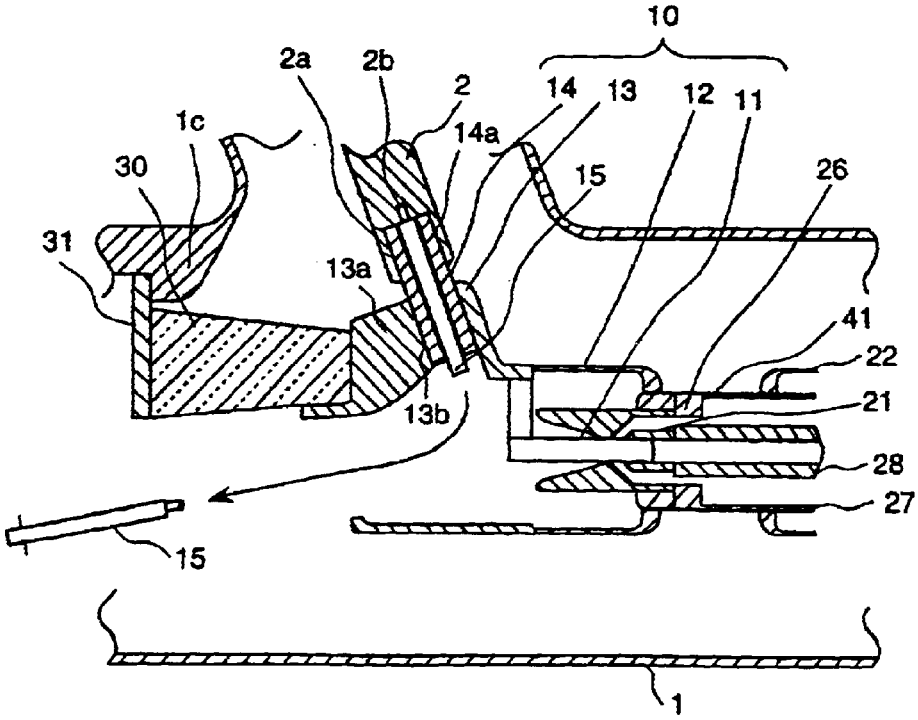
FIG. 7 is a cross-sectional view showing the procedure of a process detaching the breaker portion of the gas circuit breaker of FIG. 1.
Figure 8:
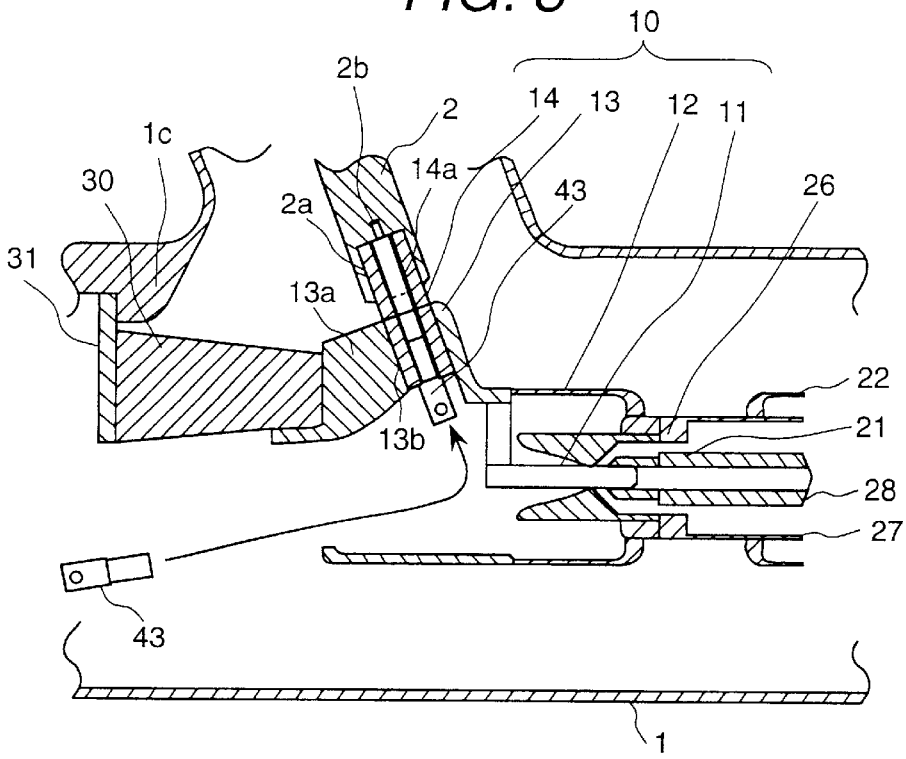
FIG. 8 is a cross-sectional view showing the procedure of a process detaching the breaker portion of the gas circuit breaker of FIG. 1.
Figure 9:
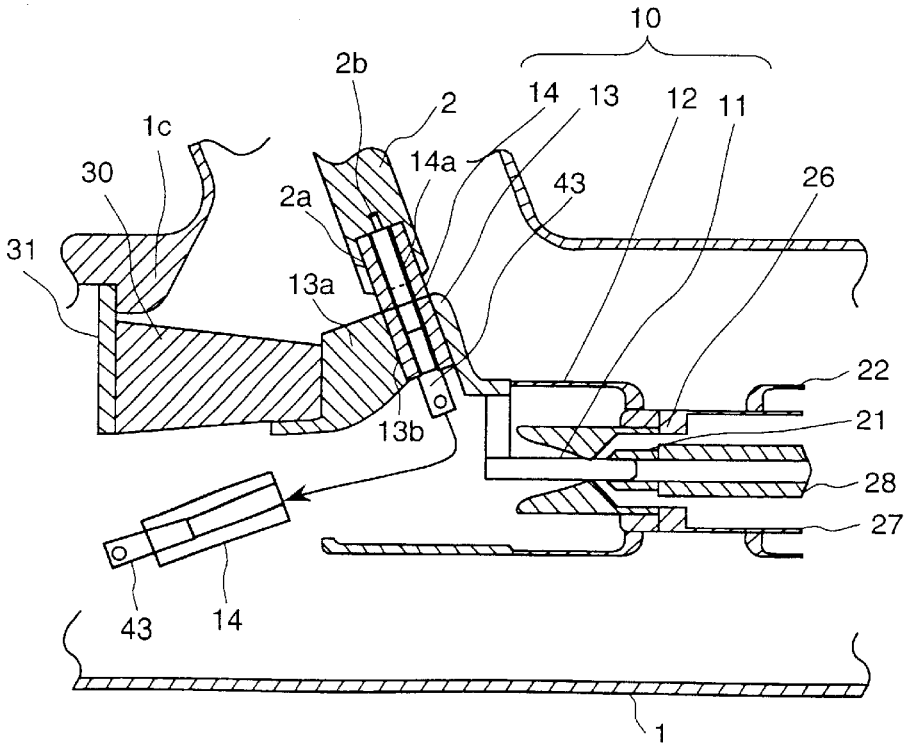
FIG. 9 is a cross-sectional view showing the procedure of a process detaching the breaker portion of the gas circuit breaker of FIG. 1.
Figure 10:
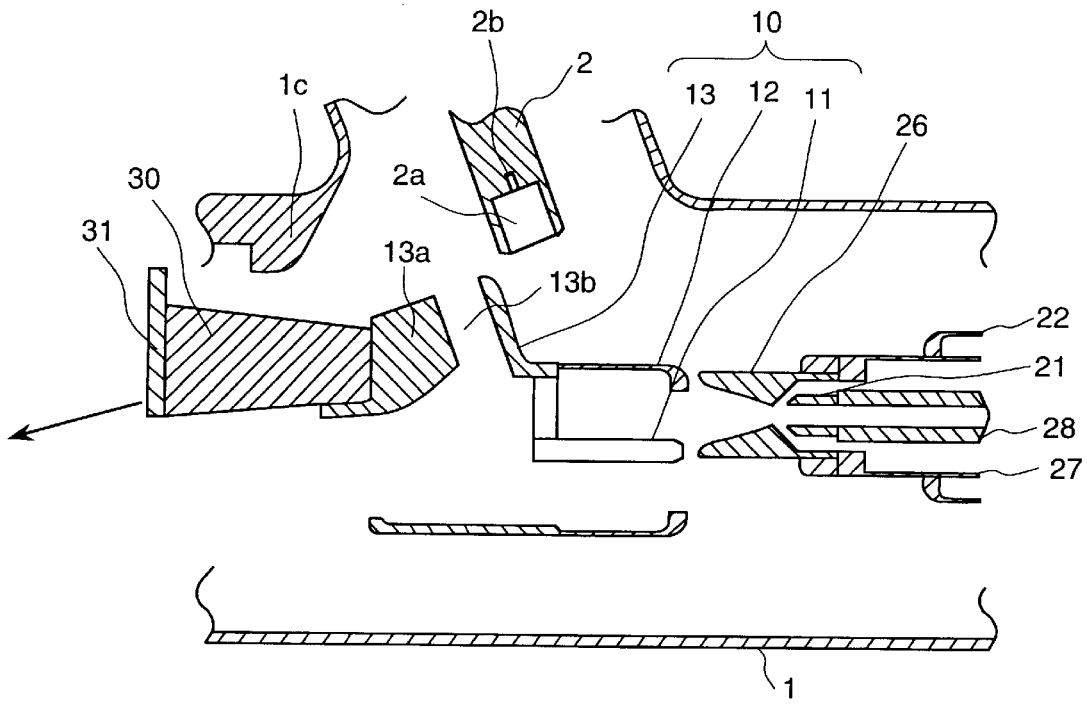
FIG. 10 is a cross-sectional view showing the procedure of a process detaching the breaker portion of the gas circuit breaker of FIG. 1.

Initially, the conductor retainer 15 screwed to be fastened together to the screw hole 2*b* of the electric conductor part 2 is removed from the connecting conductor part 14 (refer to FIG. 7). Next, a drawing tool 43 is screwed in the screw hole 14*a* of the connecting conductor part 14 (refer to FIG. 8). Then the drawing tool 43 is drawn out, and the connecting conductor part 14 is drawn out (refer to FIG. 9). Next, the fixed supporting plate 31 is removed from the fixing base lc of the grounded tank 1, and the fixed electrode 10 is removed from the electric conductor part 2 together with the fixed insulator supporting member 30 and the fixed supporting plate 31 (refer to FIG. 10). By the series of working procedures, the circuit breaking portion can be removed without detaching the electric conductor part 2. Therefore, maintenance work, inspection work and replacing work of the circuit breaking portion can be efficiently performed.

Figure 11:
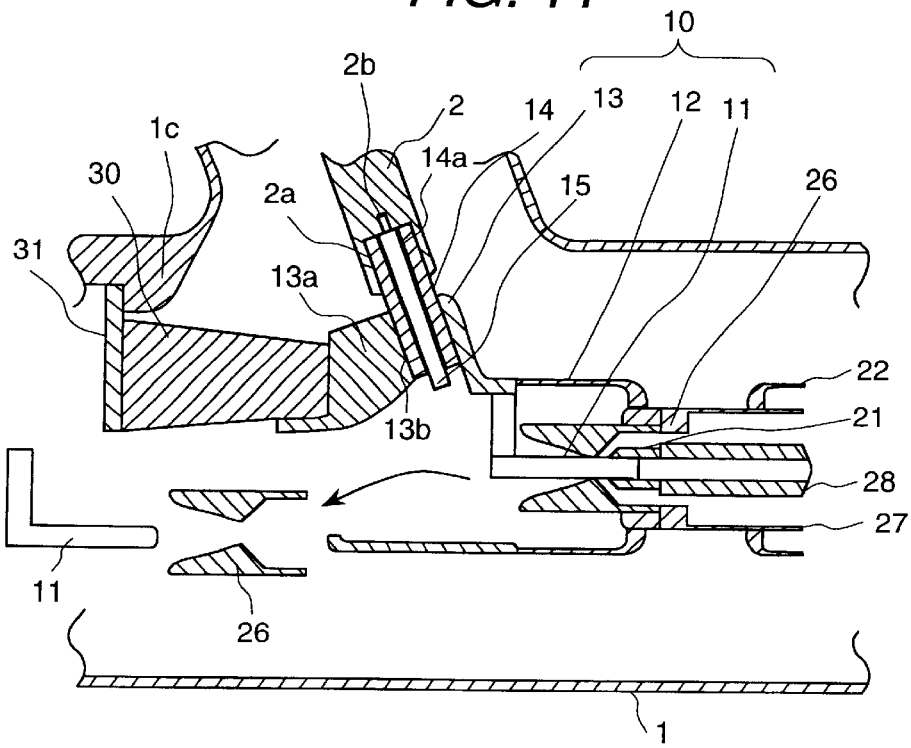
FIG. 11 is a cross-sectional view showing the procedure of a process detaching the breaker portion of the gas circuit breaker of FIG. 1.

Further, according to the present embodiment, the movable arcing contact 21 and the insulation nozzle 26 can be removed through the gas-exhausting opening of the fixed gas-exhausting conductive part 13 without removing the fixed electrode 10 side, as shown in FIG. 11.

Further, according to the present embodiment, the end portion of the grounded tank 1 in the side of the fixed electrode 10 is hermetically sealed by the lid 4, the space of the lid part and the space of the grounded tank 1 being separated by the partition plate 5, the moisture absorbent being contained in the space of the lid part. Therefore, the structure of the grounded tank 1 is not made complex compared to the case where the moisture trap is disposed in the grounded tank 1. Accordingly, the grounded tank 1 can be made small in size and low in cost.

Figure 12:
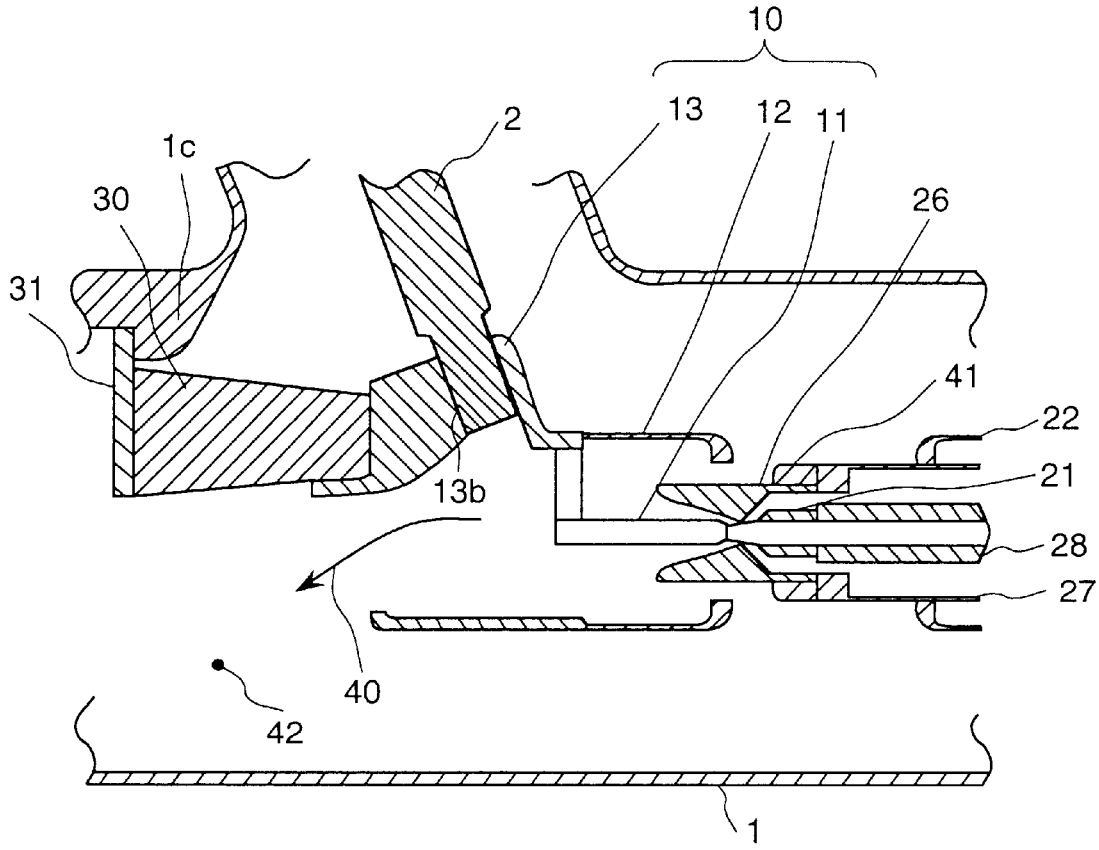
FIG. 12 is a cross-sectional view showing the structure of another embodiment of a gas circuit breaker in accordance with the present invention.

FIG. 12 shows the structure of another embodiment of a gas circuit breaker in accordance with the present invention. In this figure, parts identified by the same reference characters as in the above-described embodiment have the same functions and the same constructions, except for parts particularly described in the following description.

In this embodiment, the electric conductive part 2, the connecting conductor part 14 and the conductor retainer 15 shown in FIG. 2 are replaced by a one-piece conductor part 12. In the above-mentioned embodiment, the fixed gas-exhausting conductor part 13, the fixed insulator supporting member 30 and the fixed main contact 12 can not be removed until the work shown by FIG. 7 to FIG. 10 is done, that is, the bushing is removed. However, according to the construction of this embodiment, by integrating the above-mentioned components into the one-piece conductor part which is different from the parts in the above-mentioned embodiment, the construction of the conductor can be simplified compared to the above-mentioned embodiment, and as shown in FIG. 11, the parts easily wearing by breaking operation (the insulator nozzle 26, the fixed arcing contact 11 and the movable arcing contact 21) can be replaced and maintained without removing the bushing to shorten the maintenance time for the gas circuit breaker.

According to the present invention, since the fixed electrode is supported by the insulator supporting member in the upper side of the central axis of the grounded tank, the high temperature insulation gas is prevented from directly contact with the insulator supporting member and the performance of exhausting the high temperature insulation gas can be improved. Accordingly, it is possible to provide a gas circuit breaker capable of improving the circuit breaking performance and the insulating performance.

Further, according to the present invention, since the insulator supporting member of the fixed electrode is the solid cone, the stress acting on the insulator supporting member can be tolerated. Accordingly, it is possible to provide a gas circuit breaker tolerable of the stress acting on the supporting structure of the electrode.

What is claimed is:

1. A gas circuit breaker comprising:

a tank filled with an insulation medium;

a movable electrode arranged inside said tank that moves in a substantially horizontal direction;

a fixed electrode which is supported through a solid insulator supporting member inside said tank and disposed oppositely to said movable electrode; and electric conductive parts provided in said movable electrode and said fixed electrode, wherein said insulator supporting member has opposed ends, one of said ends is fixed through a plate to an upper side of said tank with respect to a central axis of said tank and the other of said ends is connected to said fixed electrode.

2. A gas circuit breaker comprising:

a tank filled with an insulation medium;

a movable electrode arranged inside said tank that moves in a substantially horizontal direction;

a fixed electrode which is supported through an insulator supporting member inside said tank and disposed oppositely to said movable electrode, said fixed electrode including an arcing contact and a main contact, wherein said main contact has a cylindrical shape and surrounds said arcing contact;

said insulator supporting member having opposed ends, one of said ends being fixed to an upper side of said tank with respect to a central axis of said tank and the other of said ends being connected to said fixed electrode, wherein said insulator supporting member has an elliptical frustum shape that is elliptical in cross section; and electric conductive parts provided in said movable electrode and said fixed electrode.

3. A gas circuit breaker comprising:

a tank filled with an insulation medium;

a movable electrode arranged inside said tank that moves in a substantially horizontal direction;

a fixed electrode which is supported through an insulator supporting member inside said tank and disposed detachably from and oppositely to said movable electrode; and electric conductive parts provided in said movable electrode and said fixed electrode, wherein said insulator supporting member has a shape of a solid cone and supports said fixed electrode at an upper side of said tank with respect to a central axis of said tank.

4. A gas circuit breaker according to claim 1, wherein said insulator supporting member is a circular frustum having a circular sectional shape or an elliptical frustum having an elliptical sectional shape.

5. A gas circuit breaker according to claim 1, wherein a part of said insulator supporting member at a side of said fixed electrode is covered with a conductor part of said fixed electrode.

6. A gas circuit breaker according to claim 1, wherein a conductor part of said fixed electrode is constructed so as to be detachable from said electric conductive part.

7. A gas circuit breaker according to claim 1, wherein an end portion of said tank in a side of said fixed electrode is hermetically sealed by a lid part convex outward on an axial direction of the tank, a space of said lid part and a space of said tank being separated by a partition plate, a moisture absorbent being contained in the space of said lid part.

8. A gas circuit breaker according to claim 2, wherein said insulator supporting member is a circular frustum having a circular sectional shape or an elliptical frustum having an elliptical sectional shape.

9. A gas circuit breaker according to claim 3, wherein said insulator supporting member is a circular frustum having a circular sectional shape or an elliptical frustum having an elliptical sectional shape.

10. A gas circuit breaker according to claim 2, wherein a part of said insulator supporting member at a side of said fixed electrode is covered with a conductor part of said fixed electrode.

11. A gas circuit breaker according to claim 3, wherein a part of said insulator supporting member at a side of said fixed electrode is covered with a conductor part of said fixed electrode.

12. A gas circuit breaker according to claim 2, wherein a conductor part of said fixed electrode is constructed so as to be detachable from said electric conductive part.

13. A gas circuit breaker according to claim 3, wherein a conductor part of said fixed electrode is constructed so as to be detachable from said electric conductive part.

14. A gas circuit breaker according to claim 2, wherein an end portion of said tank in a side of said fixed electrode is hermetically sealed by a lid part convex outward on an axial direction of the tank, a space of said lid part and a space of said tank being separated by a partition plate, a moisture absorbent being contained in the space of said lid part.

15. A gas circuit breaker according to claim 3, wherein an end portion of said tank in a side of said fixed electrode is hermetically sealed by a lid part convex outward on an axial direction of the tank, a space of said lid part and a space of said tank being separated by a partition plate, a moisture absorbent being contained in the space of said lid part.

16. A gas circuit breaker according to claim 1, further including a lid part at a side of said tank.

17. A gas circuit breaker according to claim 16, wherein-said lid part is of sufficient size to permit said insulator support part and said fixed electrode to be removed from said tank through said lid part.

18. A gas circuit breaker according to claim 2, further including a lid part at a side of said tank.

19. A gas circuit breaker according to claim 18, wherein said lid part is of sufficient size to permit said insulator support part and said fixed electrode to be removed from said tank through said lid part.

* * * * *